US010245486B2

(12) United States Patent
Burgess et al.

(10) Patent No.: US 10,245,486 B2
(45) Date of Patent: Apr. 2, 2019

(54) GOLF BAG HAVING HUB SHOULDER STRAP CONNECTOR FOR CONVERTING FROM TWO STRAPS TO SINGLE STRAP

(71) Applicant: Acushnet Company, Fairhaven, MA (US)

(72) Inventors: Ian Burgess, Hampstead, NH (US); Stephanie L. Howard, Boston, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/373,739

(22) Filed: Dec. 9, 2016

(65) Prior Publication Data

US 2017/0266522 A1 Sep. 21, 2017

Related U.S. Application Data

(63) Continuation-in-part of application No. 15/073,752, filed on Mar. 18, 2016.

(51) Int. Cl.
*A63B 55/00* (2015.01)

(52) U.S. Cl.
CPC ..... *A63B 55/408* (2015.10); *A63B 2209/10* (2013.01); *A63B 2225/09* (2013.01)

(58) Field of Classification Search
CPC ..... A63B 55/408; A63B 2209/10; A63B 2225/09
USPC ..... 224/579
See application file for complete search history.

(56) References Cited

U.S. PATENT DOCUMENTS 4,515,300 A * 5/1985 Cohen ..... A45C 1/04 224/153
4,953,768 A * 9/1990 Muse ..... A63B 55/53 150/159
5,038,984 A 8/1991 Izzo
5,042,703 A 8/1991 Izzo
D362,752 S * 10/1995 Steurer ..... 224/627
5,558,259 A 9/1996 Izzo
5,593,077 A 1/1997 Izzo
5,636,778 A 6/1997 Jones et al.
D409,838 S 5/1999 Steurer
D411,039 S 6/1999 Reimers et al.
(Continued)

*Primary Examiner* — Peter Helvey
(74) *Attorney, Agent, or Firm* — Daniel W. Sullivan

(57) ABSTRACT

A golf bag having a shoulder strap assembly including a two strap system that can be converted to a single strap system is provided. In the two strap system, Strap A is fitted over one shoulder and Strap B is fitted over the other shoulder. To convert from a double strap configuration to a single strap configuration, Strap A is detached and slipped over the head area and coupled to Strap B. This results in a single strap comprising both Straps A and B. The combined Straps A and B are joined together by a suitable fastening means. For example, complementary male and female members that interlock with each other on the straps can be used. The shoulder strap assembly is durable, lightweight, easy to use, and comfortable. In another embodiment, a central hub connector having four open slots for retaining the shoulder straps is provided. The Straps A and B criss-cross each other in the hub connector. Strap A or B can be removed from the hub connector to convert the two-strap assembly to a single strap assembly.

9 Claims, 16 Drawing Sheets

FIG. 12A

(56) References Cited

U.S. PATENT DOCUMENTS

D411,666 S 6/1999 Reimers et al.
D412,396 S 8/1999 Reimers et al.
D413,019 S 8/1999 Reimers
5,954,254 A 9/1999 Maeng
5,954,255 A 9/1999 Beebe et al.
5,979,727 A * 11/1999 Steurer ..... A63B 55/408 224/257
5,988,475 A 11/1999 Han
6,006,974 A 12/1999 Varney et al.
6,131,783 A 10/2000 Maeng
6,152,342 A 11/2000 Suk
6,152,343 A 11/2000 Shin
6,168,060 B1 1/2001 Mayers
D438,705 S 3/2001 Steurer
6,305,535 B1 10/2001 Fair
6,311,884 B1 11/2001 Johnson
6,457,620 B1 10/2002 Batten et al.
6,460,747 B1 10/2002 Tuerschmann et al.
6,530,129 B1 3/2003 Cheng
6,883,691 B2 4/2005 Pratt et al.
6,915,932 B1 * 7/2005 Wolfe ..... A45F 3/12 2/268
6,926,183 B2 8/2005 Chang
7,059,504 B2 6/2006 Suggs
7,131,534 B2 11/2006 Enes
7,198,183 B2 4/2007 Yang
7,270,254 B2 * 9/2007 Kakouras ..... F41C 23/02 224/150
7,387,226 B2 6/2008 Porter
8,186,549 B2 5/2012 Campbell et al.
8,322,585 B2 12/2012 Herron et al.
8,657,168 B2 2/2014 Wear et al.
8,670,891 B1 * 3/2014 Szybalski ..... B62D 1/286 701/23
8,833,622 B2 9/2014 Campbell et al.
2002/0088836 A1 * 7/2002 Batten ..... A45F 3/047 224/645
2003/0121942 A1 * 7/2003 Chang ..... A45F 3/14 224/260
2007/0051762 A1 * 3/2007 Porter ..... A45F 3/02 224/259

* cited by examiner

GOLF BAG HAVING HUB SHOULDER STRAP CONNECTOR FOR CONVERTING FROM TWO STRAPS TO SINGLE STRAP

CROSS-REFERENCE TO RELATED APPLICATIONS

This application is a continuation-in-part of co-pending, co-assigned, U.S. patent application Ser. No. 15/073,752 filed on Mar. 18, 2016, the entire disclosure of which is hereby incorporated by reference.

BACKGROUND OF THE INVENTION

Field of the Invention

The present invention generally relates to golf bags having a shoulder strap assembly and including a two strap system that can be converted to a single strap system. In the two strap system, one strap is fitted over one shoulder and the second strap is fitted over the other shoulder so that weight of the bag is borne by both shoulders of a person carrying the bag. When needed, the two straps can be easily converted to a single strap that is comfortably fitted over one shoulder.

Brief Review of the Related Art

Both professional and recreational golfers use their golf bags for many different purposes today. The bags are normally designed to carry clubs and balls, and accessories such as head covers, towels, hats, umbrellas, and golf tees. Many golf courses require that golfers walk the entire course and carry their own bags. Thus, the golfer is constantly placing the bag over his/her shoulders, removing the bag from their shoulders, and placing the bag down or standing-up the bag using a support leg mechanism on the bag. The golfer is also constantly removing and placing different clubs in the bag depending upon the shot being made. Thus, the golf bag needs to be durable, relatively lightweight, and comfortable to carry.

Many golf bags have a two strap system so the golfer can bear the weight of the bag on both shoulders. The first strap fits over a person's first shoulder and the second strap fits over the second shoulder. These dual straps tend to help improve the weight distribution of the bag and less weight stress is placed on each shoulder. The person carrying the bag tends to have better balance while walking with the bag because of this improved weight distribution. However two strap systems have some drawbacks. For example, placing the bag over the first shoulder and placing the bag over the second shoulder can be burdensome. Sometimes, the golfer may easily place the first strap over the first shoulder, but then have difficulty finding and swinging the second strap over the second shoulder. The golfer may have to twist their back and arms at odd angles in order to swing the second shoulder strap over their second shoulder. This turning and twisting can lead to back and arm injuries. Thus, the golfer may wish to use just a single strap in many instances. In this way, the golf bag can be easily slipped over one shoulder. Also, in some instances, caddies will carry two separate golf bags and will want the carrying straps on the bags to easily convert from a double strap system to a single strap system. In such cases, the straps are adjusted so one strap and weight of one golf bag is borne by the left shoulder and one strap and weight of the other golf bag is borne by the right shoulder. Both the double strap and single strap systems need to be durable and have high mechanical strength. In view of the different needs of golfers, the golf gear industry has looked at different ways for making bags having double and single carrying straps.

For example, Suk, U.S. Pat. No. 6,152,342 discloses a golf bag having a strap system with a restraining buckle. The buckle contains four openings for threading the straps. According to the '342 Patent, the buckle prevents the two shoulder straps from sliding off the shoulders. The buckle can be used to adjust the length of the shoulder straps in the angular direction.

Mayers, U.S. Pat. No. 6,168,060 discloses a strap system for a golf bag that can be converted from a one shoulder to a two-shoulder type. The strap comprises two layers that may be secured together by hook and loop fasteners and secured to the upper and lower back rings by hooks, so that the strap functions as a one-shoulder strap. Alternatively, strap layers may be separated from each other and the lower ring used as a slip through ring for an elongated belt that encircles the chest of the golfer.

Cheng, U.S. Pat. No. 6,530,129 discloses a golf bag having a strap system with a ratchet buckle containing four elongated through-slots with serrated inner walls. According to the '129 Patent, the buckle prevents the two shoulder straps from twisting together when the bag is being carried on the back.

Campbell et al., U.S. Pat. No. 8,186,549 discloses a golf bag having double straps. The secondary strap is connected to the primary strap by a movable engagement device that rotates. The movable engagement device may include a movement limiting piece that prevents the secondary strap from moving too far out of the reach of the person carrying the bag.

Herron et al., U.S. Pat. No. 8,322,585 and Wear et al., U.S. Pat. No. 8,657,168 disclose a golf bag having a strapping system with two main straps. In the double strap configuration, the first strap member has three ends, each of which is attached to the bag, and the second strap member has one free end attached to the bag and one free end attached to a central area of the first strap member. When converting to the single strap configuration, the first strap member is removed from the bag completely, and the free end of the second strap member that was attached to the first strap member is removed therefrom and engaged with the bag.

In many of these systems having double and single carrying straps, it can be awkward and uncomfortable constantly switching from two straps to one strap. In some cases, one of the straps may need to removed completely or detached so that it is hanging off the bag, and this can be a distraction. In other cases, spending time and energy on working the strapping system can lead to fatigue and negatively affect playing performance on the golf course.

There is a need for a golf bag having an improved two strap system that can be converted to a single strap system. A person using the bag should be able to convert from the two-strap to single-strap system and vice versa easily and comfortably. The present invention provides such a shoulder strap assembly and golf bag that is durable, lightweight, easy to carry, and comfortable and includes other advantageous properties and features.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
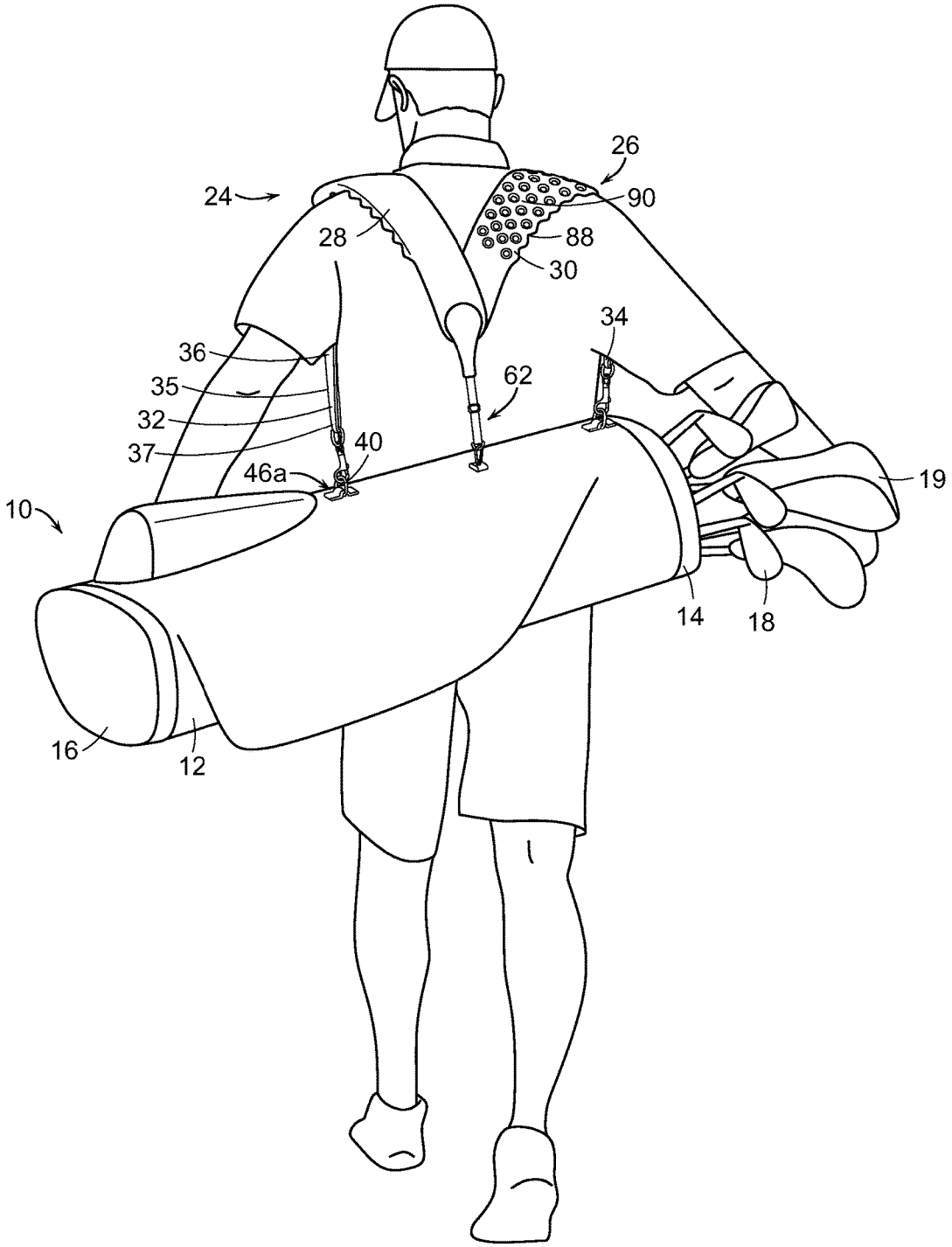
FIG. 1 is a rear perspective view of a person carrying one embodiment of the golf bag of this invention including shoulder strap assembly, wherein the person is using two shoulder straps to carry the bag according to the present invention.

Referring to FIG. 1, the golf bag (10) includes an elongated tubular body (12) having an open end (14) and an opposing closed end (16). Golf clubs (18) can be inserted into the tubular body (12) so that the golf club heads with head covers (19) are projecting from the open end (14) of the golf bag (10). The sidewall of the tubular body (12) may include pockets and rings, and other compartments for golf balls, and accessories such as towels, hats, gloves, golf tees, beverages, and the like. The tubular body (12) can be made of any suitable textile material including leather, and woven/non-woven fabrics. Also, the golf bag (10) may include a carrying handle and support leg assembly (not shown).

The golf bag (10) also includes two shoulder straps (24, 26) that are attached to the bag (10) as described in further detail below. The dual straps (24, 26) form two relatively large circular openings where a person can insert his/her arms through and then place the respective straps (24, 26) over their shoulders. The golf bag (10) is supported by the shoulder straps (24, 26) and balanced on the person's back region of their body. In FIG. 1, the strap (24) is shown placed over the left shoulder and the strap (26) is shown placed over the right shoulder. However, it should be understood the terms, "lower", "upper", "top", "bottom", "right', "left", "proximal", "distal" and the like are arbitrary terms used to refer to one position of an element based on one perspective and should not be construed as limiting the scope of the invention.

Shoulder Straps

In general, each shoulder strap (24, 26) includes three segments. Primarily, each strap (24, 26) includes a cushioned portion (28, 30), which is discussed in further detail below. These centrally located padded sections (28, 30) are made of a relatively thick, cushioned material. The cushioned portions (28, 30) rest on the golfer's shoulders so that the bag is well supported and he/she can carry the bag (10) comfortably. The shoulder straps (24, 26) also include connector webbing strap portions (32, 34), that are made of a relatively thin, short webbing material and have minimal or no padding. The shoulder straps (24, 26) also includes a hub connector webbing strap portion (62) that is connected to the cushioned portions (28, 30) as discussed in further detail below.

Referring to shoulder strap (24) in FIG. 1, the cushioned portion (28) is adjoined to a connector webbing strap portion (32) that generally rests against the chest area of the person carrying the bag. The upper (proximal) end (35) of the connector strap (32) is adjoined to the first end (36) of the padded section (28) by stitching, adhesive or other suitable means. The opposing lower (distal) end (37) of the connector webbing (32) is attached to the body of the bag (10). This attachment point for the shoulder strap (24) can be referred to as a first bag attachment point. For example, this lower end (37) of the connector webbing (32) may be attached to a connector ring (40) having any suitable shape (for example, D-shaped, circular, oval, rectangular, and the like) that is pivotally attached to the body of the bag (10). Preferably, a D-shaped connector ring (40) is used. Particularly, the connector webbing (32), via lower end (37), may be removably attached to the D-shaped ring connector (40) by a clasp, buckle, shackle, clip, snap button, laces, ties, hook and loop fastener fabric, or any other suitable fastening means.

Figure 1A:
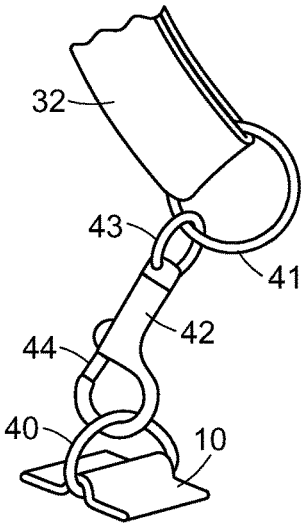
FIG. 1A is a close-up view of one connector webbing of one shoulder strap as shown in FIG. 1 showing the webbing attached to the golf bag according to the present invention.

More particularly, as shown in FIG. 1A, for example, a spring-loaded clip (42) may be used. Here, the free end (37) of the connector webbing (32) may be attached by a connector ring (41) to the fixed round loop (43) of the clip (42). The connector ring (41) is shown having a circular-shaped structure, but it may have any suitable shape (for example, D-shaped, oval, rectangular, and the like.) The spring-loaded clip (42) includes a spring-loaded sliding piece (44) and this may be used to secure the clip to the pivotal D-shaped connector ring (40) located on the body of the bag (10). In another example, the free end (37) of the connector webbing (32) may be inserted directly into the fixed loop (43) of the clip and then the connector webbing (32) may be passed through a buckle, tri-glide clip, slide piece, or other adjusting member that allows the shoulder strap (24) to be adjusted lengthwise.

Figure 1B:
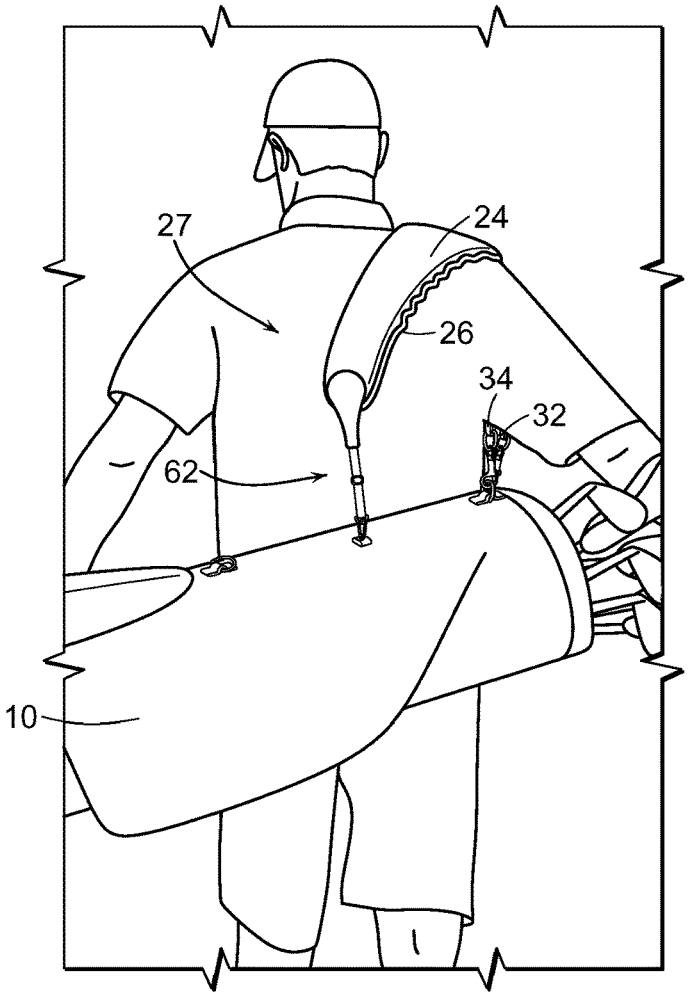
FIG. 1B is a rear perspective view of a person carrying one embodiment of the golf bag of this invention including shoulder strap assembly as shown in FIG. 1, wherein the two shoulder straps have been converted to one shoulder strap and the person is using the one shoulder strap to carry the bag according to the present invention.

Now turning to FIG. 1B, since the connector webbing (32) is removably attached to the D-shaped connector ring (40) on the body of the bag (10), it can be easily detached from the the bag (10). Then, the left-sided shoulder strap (24) can be swung over the head region of the person carrying the bag to the right-sided shoulder, where it is coupled to the opposing shoulder strap (26) to form a single strap configuration (27) as described further below. The spring-loaded clip (42) is detached from the D-shaped ring (40) on the left-side of the bag (10) and attached to a D-shaped ring (or other suitable attachment point—not shown) on the right-side of the bag (10). The bag attachment point of the right-sided shoulder strap (26) is similar to the left-sided shoulder strap (24). This bag attachment point for the shoulder strap (26) can be referred to as a second bag attachment point.

Figure 2:
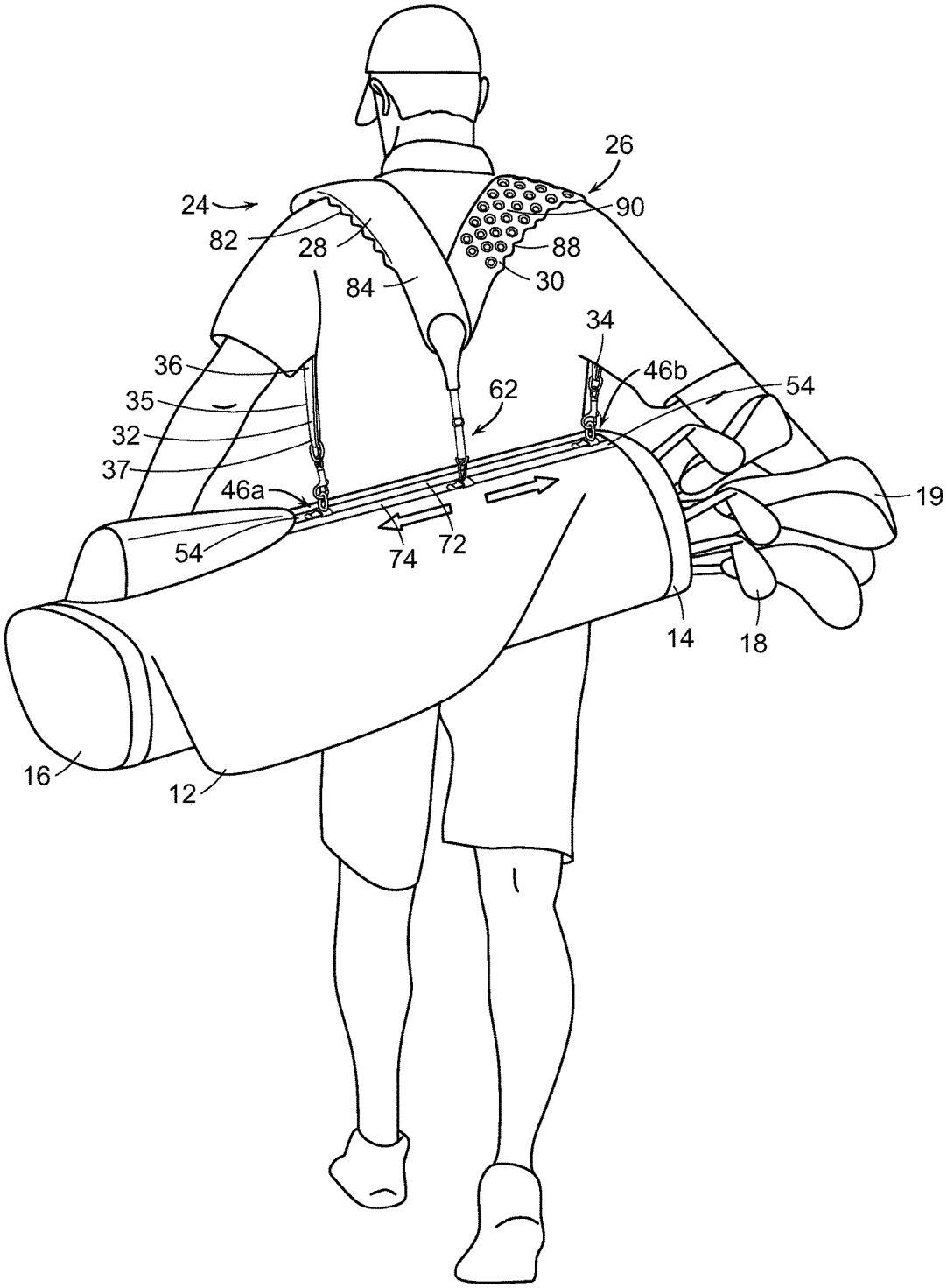
FIG. 2 is a rear perspective view of a person carrying one embodiment of the golf bag of this invention including shoulder strap assembly and sliding block members, wherein the person is using two shoulder straps to carry the bag according to the present invention.
Figure 2A:
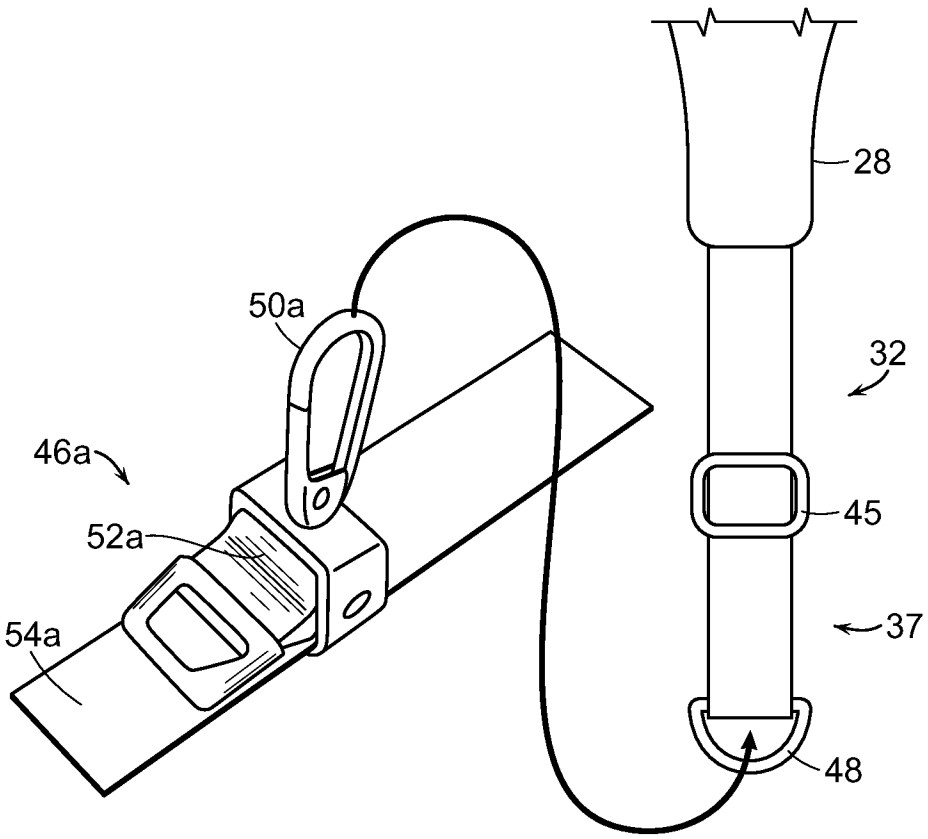
FIG. 2A is a close-up view of a connector webbing strap portion as shown in FIG. 2 showing the strap attached to one embodiment of a sliding block member according to the present invention.

Referring to FIG. 2, in an alternative version, the free lower end (37) of the connector webbing strap portion (32) is removably attached to a slider assembly (46*a*). More particularly, as shown in FIG. 2A, this lower end (37) of the connector webbing (32) may have a D-shaped ring (48), and this may be attached to a sliding assembly (46*a*) comprising a carabiner (50*a*) mounted on a sliding block member (52*a*) which moves along a track (54*a*). The sliding block (52*a*) is slidingly mounted on the track (54*a*) so that it can be moved to a selected position and then locked in place. Different sliding assemblies and locking mechanisms can be used in accordance with this invention. For example, the sliding assembly (46*a*) may be locked in place by a cam-lock mechanism. In one version, the end of the connector webbing (32) is inserted through the D-shaped ring (48) to form a loop and then it is stitched back on itself. In another version, as shown in FIG. 2A, the free end (37) of the connector webbing (32) is inserted into the D-shaped ring (48) to form a loop and then it is passed through a buckle, tri-glide clip, slide piece, or other adjusting member (45) that allows the shoulder strap (24) to be adjusted lengthwise.

As further shown in FIG. 2, the attachment points of the right-sided shoulder strap (26) are similar to the left-sided shoulder strap (24). For example, the opposing end of the connector webbing (34) is removably attached to a slider assembly (46*b*), which also may comprise a carabiner (50*b*) mounted on a sliding block member (52*b*) which moves along a track (54). The free end of the connector webbing (34) on the right-sided shoulder strap (26) also may have a D-shaped ring (48*b*), and this also may be attached to the carabiner (50*b*). Like the sliding block (52*a*) for the left-sided shoulder strap (24), the sliding block (52*b*) for the right shoulder strap is slidingly mounted on the track (54) so that it can be moved to a selected position and locked in place. Thus, in this embodiment, the first and second sliding blocks (52*a*, 52*b*) are mounted on the same, single sliding track (54) fastened to the bag (10). In an alternative embodiment (not shown), there may be two separate tracks: i) Track One (54*a*) for sliding block (52*a*); and Track Two (54*b*) for sliding block (52*b*).

As shown in FIGS. 1 and 2, the attached shoulder straps (24, 26) form two generally circular openings where a person can insert his/her arms through so that the shoulder straps (24, 26) rest on the shoulders. The shoulder straps (24, 26) can be adjusted so that the weight of the bag (10) is evenly distributed and the bag is centered on the person's back. In particular, the slider assemblies (46*a*, 46*b*) and shoulder straps (24, 26) are adjusted depending upon the shoulder width of the golfer. For example, if the golfer has a small shoulder span, the sliding blocks (52*a*, 52*b*) can be moved closer together (towards the center of the track) and this will move the shoulder straps (24, 26) closer together. The gap between the shoulder straps (24, 26) is narrowed. On the other hand, if the golfer has a large shoulder span, the sliding blocks (52*a*, 52*b*) can be moved apart (toward the opposing end of the track) and this will move the shoulder straps (24, 26) farther apart. The gap between the shoulder straps (24, 26) is widened.

Figure 3:
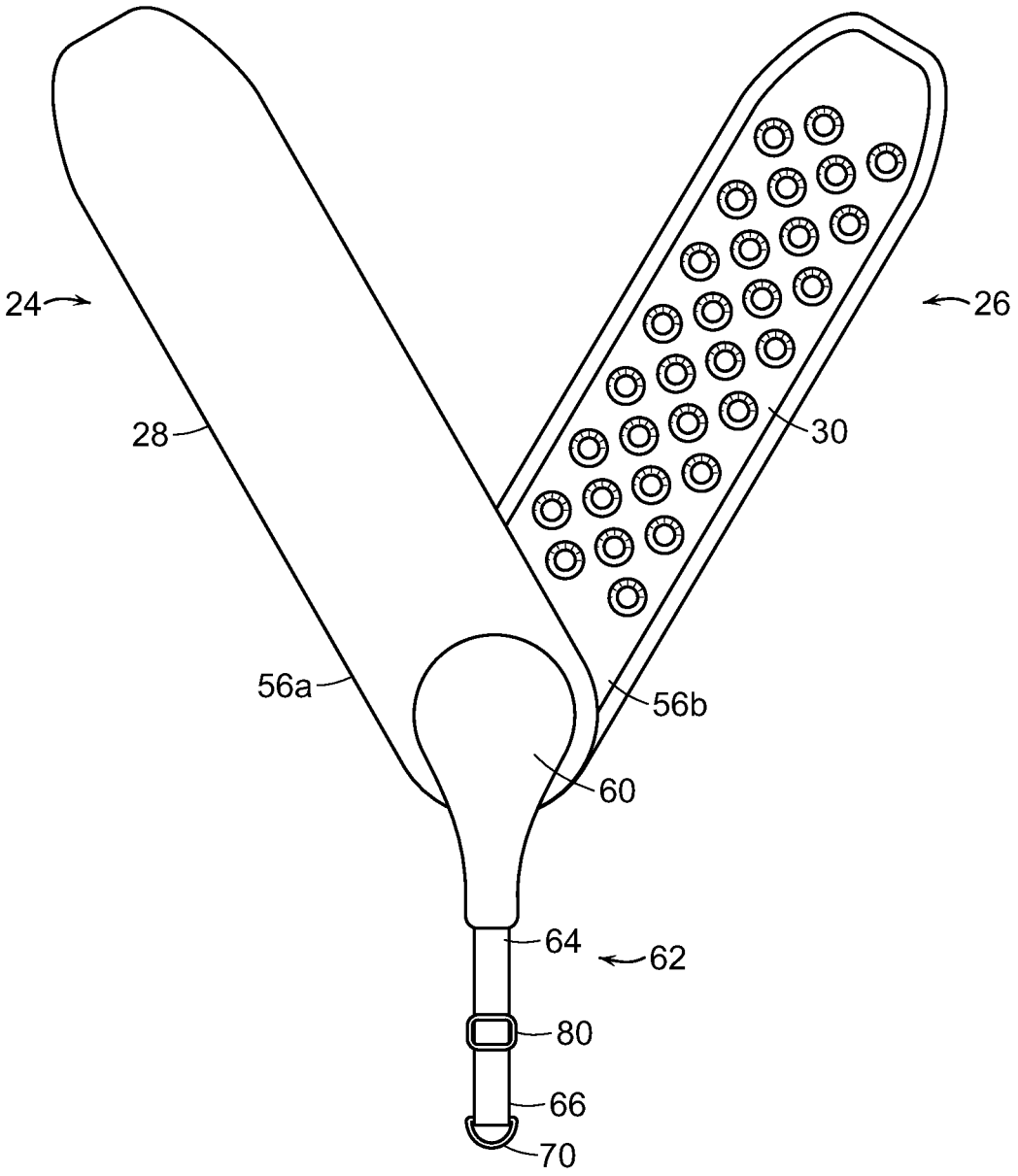
FIG. 3 is a rear perspective view of one embodiment of the shoulder strap assembly including hub connector strap according to the present invention.

Referring to FIG. 3, in shoulder strap (24), the lower end (56*a*) of the cushioned portion (28), which rests against the mid-back region of the person carrying the bag (10), is joined to the lower end (56*b*) of the cushioned portion (30) of shoulder strap (26) by a rotatable hub plate (60). As shown in FIG. 3, the shoulder straps (24, 26), and particularly cushioned portions (28, 30), form a V-shaped pattern, on the person's back region. In turn, the hub plate (60) is attached to the body of the bag by a hub connector strap (62). The hub plate (60) rotates so that the cushioned portions (28, 30) of the shoulder straps (24, 26) can be moved back and forth in a generally horizontal direction. For example, as the left-sided shoulder strap (24) is swung over the head region to the right-sided shoulder, the hub plate (60) rotates and the shoulder strap (24) pivots so that cushioned portion (28) can be joined to the cushioned portion (30) of the opposing shoulder strap (26) to form a single strap configuration (27) as illustrated in FIG. 1B.

Hub Connector Strap

The hub connector strap (62) is typically made of a relatively thin, short webbing material. The hub support strap (62) connects the rotatable hub plate (60) to the body of the bag (10) and does not rest on the golfer's shoulders so this strap (62) normally does not have any padding.

Referring to hub connector strap (62) in FIG. 3, the strap has an upper (proximal) end (64) attached to the hub plate (60) by stitching, adhesive, or other suitable means. The opposing lower (distal) free end (66) of the hub connector strap (62) is attached to the body of the bag (10). This attachment point can be referred to as a third bag attachment point for the shoulder straps (24, 26). The lower free end (66) of the hub strap (62) may have a D-shaped connector ring (70) so that it can be removably attached to a slider assembly similar to the above-described sliding assemblies (46*a*, 46*b*) or other attachment point on the bag (not shown in FIG. 3) as described further below.

Figure 4:
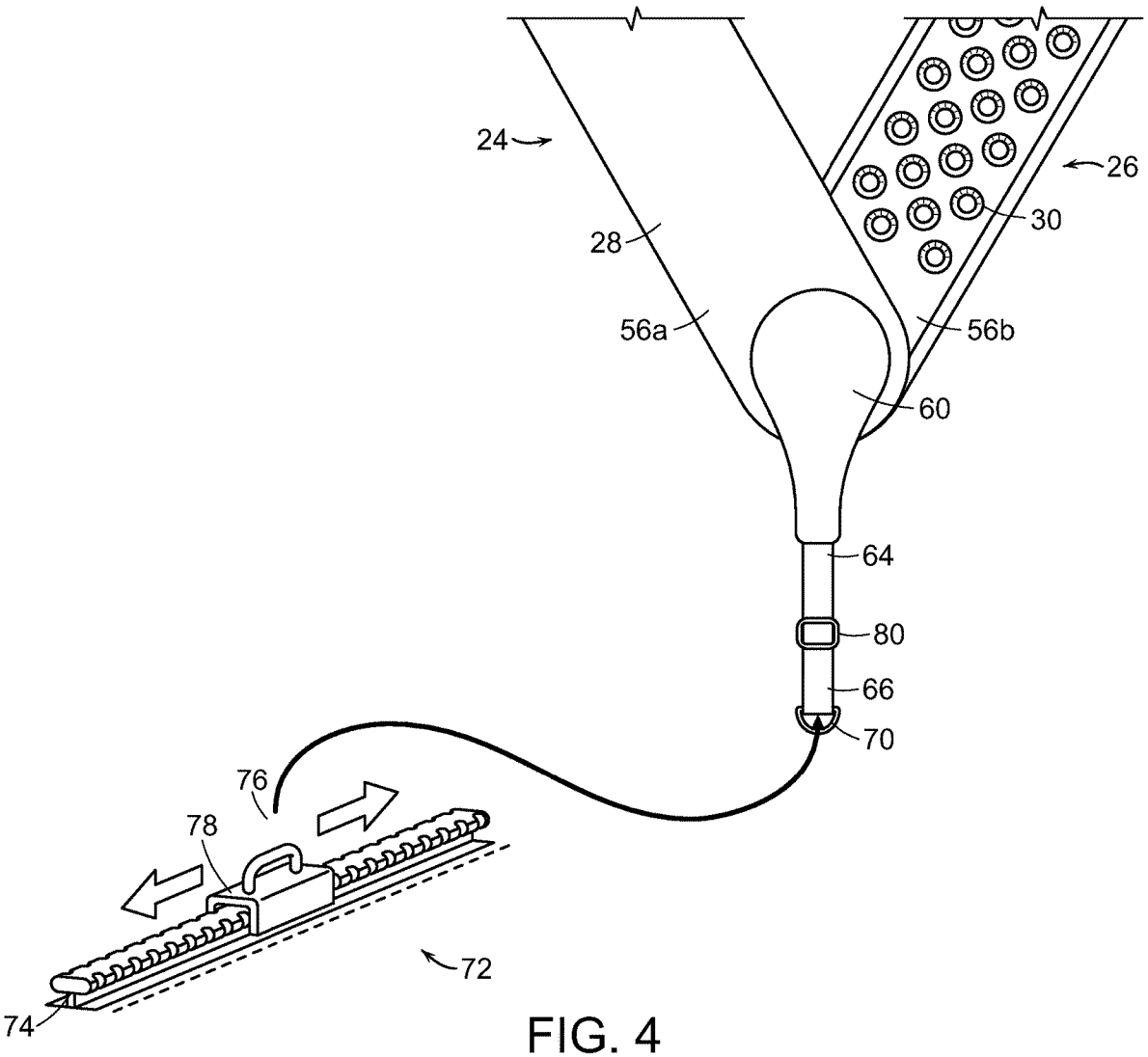
FIG. 4 is a perspective view of the shoulder strap assembly in FIG. 3 showing the hub connector strap attached to one embodiment of a sliding block member according to the present invention.

Referring to FIG. 4, in another embodiment, a different slider assembly (72) is shown. This slider assembly (72), which includes U-shaped handle (76) mounted on a sliding block member (78) that moves along the track (74), can be used for attaching hub connector strap (62) and also for connector webbings (32, 34) as discussed above. Here, in FIG. 4, the lower (distal) free end (66) of the hub connector strap (62) is shown removably attached to the sliding block member (78), which is mounted on the track (74). More particularly, this end (66) of the hub strap (62) may have a D-shaped ring (70), and this may be attached to the U-shaped handle (76). The sliding block (78) is slidingly mounted on the track (74) so that it can be moved to a selected position and then locked in place. In FIG. 4, the sliding block (78) is locked in place by interlocking teeth on the sliding block (78) and track (74). Also, as shown in FIG. 4, in one version, the lower free end (66) of the hub connector strap (62) is inserted into the D-shaped ring (70) to form a loop and then it is passed through a buckle, tri-glide clip, slide piece, or other adjusting member (80) that allows the hub strap (62) to be adjusted lengthwise.

In an alternative version, the distal end (66) of the hub connector strap (62) is attached to the body of the bag (10) in a way that does not use a slider assembly (72). For example, as shown in FIGS. 1, 1A, and 1B the lower end (66) of the hub connector strap (62) might be fastened to the bag (10) itself. For example, hub connector strap (32) may be attached using a spring-loaded clip (42) and connector rings (40, 41) of any suitable shape (for example, D-shaped, circular, oval, rectangular, and the like in a manner similar to the attachment of the connector webbing (32) shown in FIG. 1A. In other embodiments, the connector strap (62) may be removably attached to the bag (10) by a clasp, buckle, shackle, snap button, laces, ties, hook and loop fastener fabric, or any other suitable fastening means.

Conversion of Double-Strap to Single-Strap.

Figure 5B:
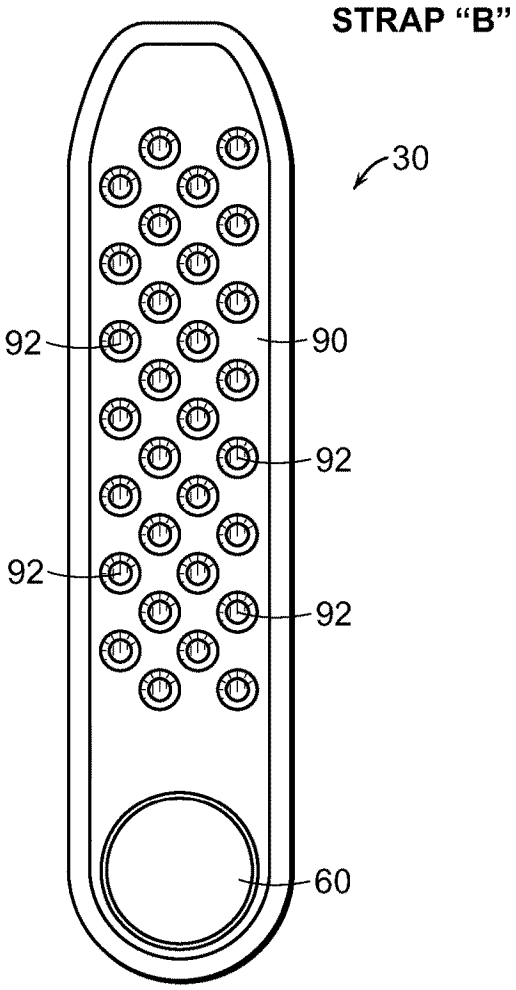
FIG. 5B is a planar front exterior view of one embodiment of a shoulder strap showing pockets for receiving the projecting members of the shoulder strap in FIG. 5A so that the shoulder straps are joined together according to the present invention.
Figure 5A:
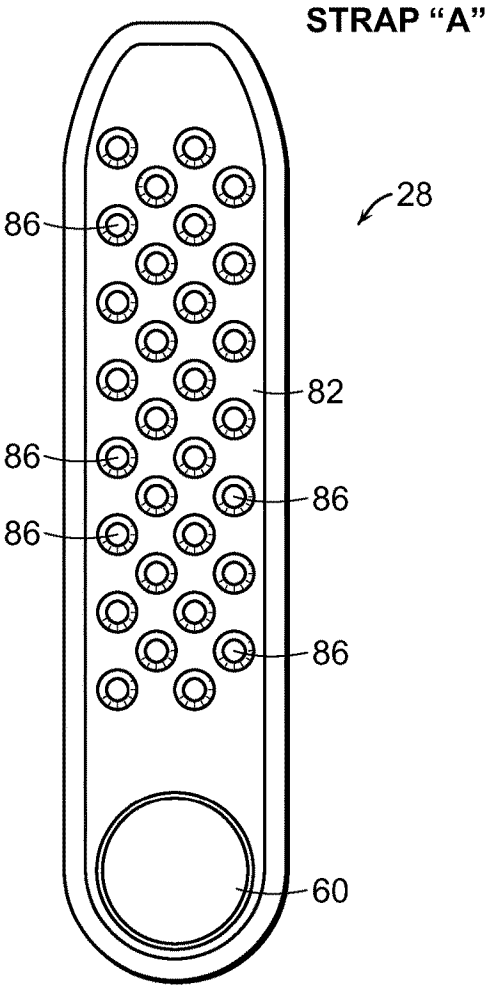
FIG. 5A is a planar interior surface view of one embodiment of a shoulder strap showing projecting members according to the present invention.

To convert from a double-strap (24, 26) configuration to a single strap (27) configuration, Strap A, which is fitted on one shoulder, is detached and slipped over the head area and coupled to Strap B, which is fitted on the opposing shoulder. This results in a single strap comprising both Straps A and B. For example, as shown in FIGS. 1, 1A, and 1B, the left-sided strap (24) may be detached and slipped over the head and then coupled to the right-sided strap (26) to form a single strap (27). The combined straps (24, 26) are joined together by a suitable fastening means. For example, the straps may be joined by tiny hook and loop fabric fasteners, commonly referred to as Velcro™. In one preferred embodiment, the straps (24, 26) have complementary male and female members that interlock with each other. For example, as shown in FIGS. 5A and 5B, the cushioned portion (28) of Strap A may contain male members (86) and the cushioned portion (30) of Strap B may contain female members (92). These complementary interlocking members (86, 92) are joined and stacked together in a manner similar to stacked egg cartons. The male and female members (86, 92) interlock with each other to form a single strap construction (27) (FIG. 1B). The male members (86) can have any suitable thickness, for example, the members can have a thickness in the range of about 2 to about 10 mm. The male and female members (86, 92) also can have any desirable shape such as, for example, circular, oval, triangular, square, pentagonal, hexagonal, heptagonal, octagonal, and the like, and the members can be arranged in any desirable geometric pattern such as, for example, grids and pie-sections. Thus, the cushioned portions (28, 30) of the shoulder straps can be designed to have a sporty and fashionable appearance.

Also, the cushioned portion (28) of Strap A and cushioned portion (30) of Strap B are relatively thick, padded sections that comfortably fit over the shoulders of the person carrying the bag. The cushioned portions (28, 30) can have any suitable thickness, for example, the cushioned portions (28, 30) can have a thickness in the range of about 5 to about 50 mm, and more preferably in the range of about 10 to about 40 mm. In FIGS. 1 and 2, shoulder strap (24) with cushioned portion (28) is shown resting on the left shoulder of the person carrying the bag (10). The padded section (28) includes an interior surface (82), which faces inwardly and is in contact with the person's body, and exterior surface (84) which is exposed and faces outwardly. Referring to FIG. 5A, the interior surface (82) of the cushioned portion (28) is shown in more detail. The exterior surface (84) of cushioned portion (28), which is exposed and faces outwardly from the person's body, is not shown in FIG. 5A. This interior surface (82) includes tiny male projection members (86) arranged in a geometric pattern.

Also, as illustrated in FIGS. 1 and 2, shoulder strap (26) with cushioned portion (30) is shown resting on the right shoulder of the person carrying the bag (10). The padded section (30) includes an interior surface (88), which faces inwardly and is in contact with the person's body, and exterior surface (90) which is exposed and faces outwardly. Referring to FIG. 5B, the exterior surface (90) of cushioned portion (30) is shown in more detail. The interior surface (88), which faces inwardly and is in contact with the person's body is not shown in FIG. 5B. This exterior surface (90) includes tiny female pockets (92). The projecting members (86) on the interior surface (82) of the cushioned section (28) of Strap A will be mated to the pockets (92) on the exterior surface (90) of cushioned portion (30) of Strap B. When Strap A is detached from the bag (10) and pulled over the head region as described above, it is joined to opposing Strap B by mating the complementary nubs (86) and pockets (92) together to form a single strap (27) construction. It is also recognized that other coupling systems for joining straps (24, 26) together (for example, snap-fasteners, Velcro™ hook and loop fasteners, tie fasteners, and the like) may be used in addition to or in place of the male/female members (86, 92).

To convert the single strap (27) back to a double strap (24, 26) configuration, the person carrying the bag separates the straps (24, 26) from each other by simply pulling upwardly on the top strap of the single strap construction (27). For example, the person may easily pull on top strap (24) so that it separates from bottom strap (26); slip strap (24) over his/her head; and then reattach it to the first attachment point on the bag (10) as described above.

Materials

The cushioned portions (28, 30) of the shoulder straps (24, 26) can be made of any suitable material including, but not limited to, foams, natural and synthetic leathers, natural and synthetic rubbers, woven and non-wovens, and natural and synthetic fabrics. Foamed materials are particularly preferred for constructing the cushioned portions (28, 30). These foamed materials have good stability and yet are also sufficiently flexible to make the cushioned portions (28, 30) comfortable when resting on the shoulders. These foamed materials can have a relatively soft durometer, for example, the hardness can be in the range of about 10 to about 80 Shore A. Another hardness scale (Asker° C.) can be used to measure the indentation hardness of the foams, soft rubbers, elastomers or other materials, and the Asker C hardness is normally in the range of 25 to 75.

In general, foam compositions are made by forming gas bubbles in a polymer mixture using a foaming (blowing) agent. As the bubbles form, the mixture expands and forms a foam composition having either an open or closed cellular structure. Many foams contain both open and closed cells. Various thermoplastic and thermoset materials may be used in forming the foam compositions as discussed further below. In one preferred embodiment, a polyurethane foam composition is used to form the foam material. In another embodiment, ethylene vinyl acetate (EVA) foams are used. In a particularly preferred embodiment, a high-stretch, high-recovery foam material referred to as AriaPrene™, and available from Tiong Long Corp. can be used. This foam material is hypo-allergenic, lightweight, non-toxic, and decomposable.

Other thermoplastic elastomers that can be used in accordance with this invention include polyester-polyether block copolymers such as Hytrel® resins, available from DuPont. These block copolymers are available in different grades and contain hard (crystalline) segments of polybutylene terephthalate and soft (amorphous) segments based on long-chain polyether glycols. Polyether-amide block copolymers, which are commonly known as Pebax® resins, and are available from Arkema, Inc. (Columbs, France), also may be used. Other suitable thermoplastic polymers include, but are not limited to, polyurethanes, polyureas, silicones, ethylene acid copolymer ionomers, polyesters, polyolefins, polyamides, polyamide-ethers, polyamide-esters; fluoropolymers, polystyrenes, polyvinyl chlorides, polycarbonates, polyethers, and polyimides including homopolymers, copolymers, and modified polymers and blends thereof.

Natural and synthetic rubber materials also may be used. Suitable rubber materials include, but are not limited to, polybutadiene, polyisoprene, ethylene propylene rubber ("EPR"), ethylene-propylene-diene ("EPDM") rubber, styrene-butadiene rubber, styrenic block copolymer rubbers (such as "SI", "SIS", "SB", "SBS", "SIBS", "SEBS", "SEPS" and the like, where "S" is styrene, "I" is isobutylene, "E" is ethylene, "P" is propylene, and "B" is butadiene), polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and blends of two or more thereof.

The connector webbing (32, 34) and hub connector strap (62) of the shoulder straps (24, 26) also can be made of any suitable fabric material. The same or different fabric materials can be used to construct the connector webbing (32, 34) and hub connector strap (62). Preferably, the connector webbing (32, 34) and hub connector strap (62) is made of a lightweight, high-strength fabric material. For example, woven fabric made of nylon, polypropylene, or polyester, can be used as the webbing. Elastic webbing made of spandex or rubber fabric material also can be used. The webbing normally is relatively thin and has minimal or no padding. As discussed above, the hub connector strap (62) is attached to the hub plate (60) which can be made of plastic, metal, composite, or other suitable material.

As discussed above, the golf bag of this invention is lightweight and durable and includes a two strap system that can be converted to a single strap system. In the two strap system, one strap is fitted over one shoulder and the second strap is fitted over the other shoulder so that the weight of the bag is borne by both shoulders of a person carrying the bag. When needed, the two straps can be easily converted to a single strap that is comfortably fitted over one shoulder so that the weight of the bag is borne by one shoulder. In both instances, the straps are comfortably fitted over the shoulder (s) and the bag is easy to carry. As needed, the straps can be easily converted from a double to a single and back to a double-strap system. Thus, the amount of weight stress placed on each shoulder can be quickly adjusted. The person carrying the bag can decide which strap system he/she would like to use depending upon the playing circumstances. The golfer can easily change strap systems while walking the course. Because the strap system is so easily convertible, the golfer does not need to spend much time and energy fiddling with the straps, and he/she can better concentrate on their play.

Hub Shoulder Strap Connector

Figure 6A:
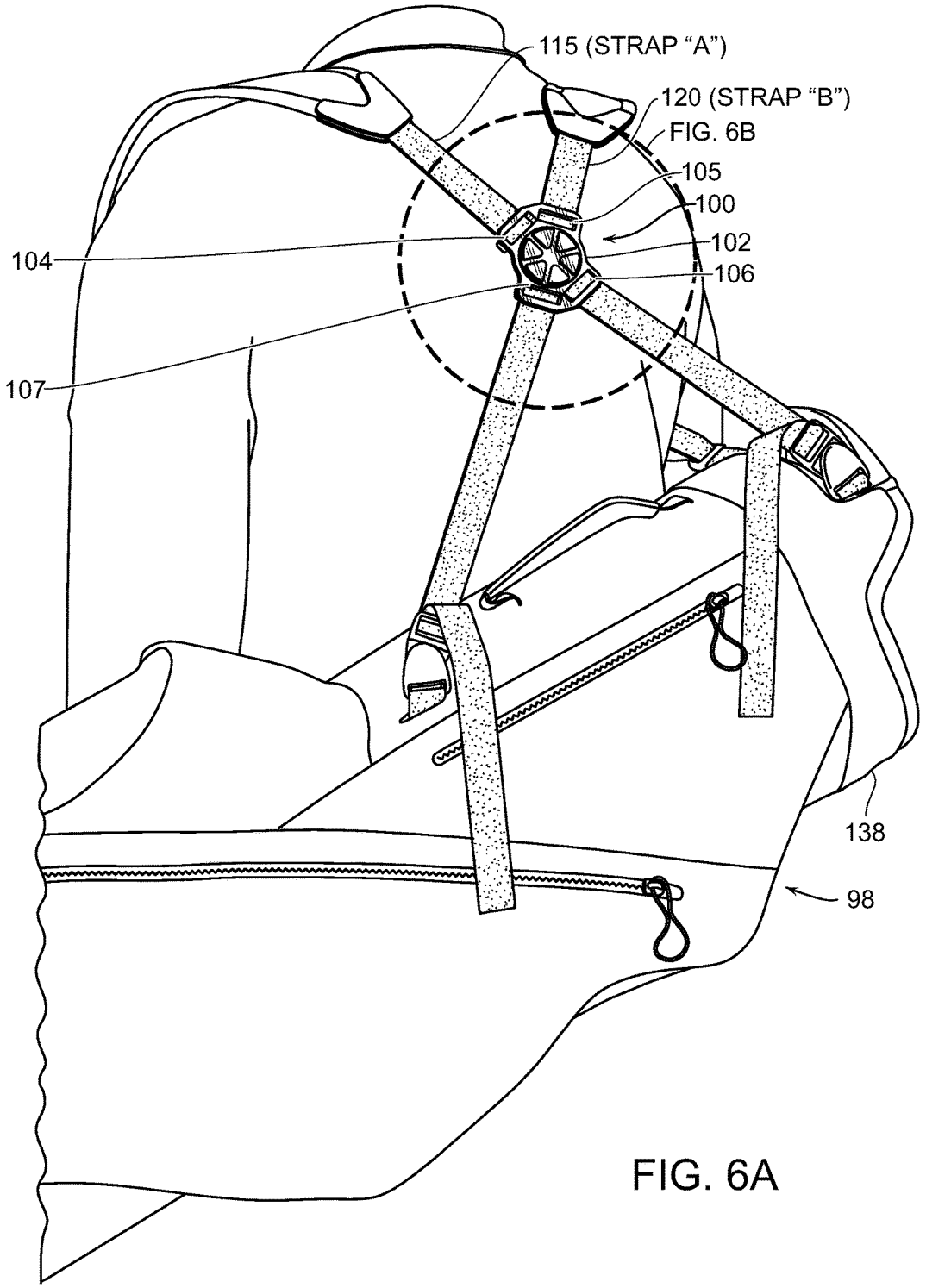
FIG. 6A is a first rear perspective view of a person carrying another embodiment of the golf bag of this invention with a hub shoulder strap connector, wherein the person is using two shoulder straps to carry the bag.
Figure 6B:
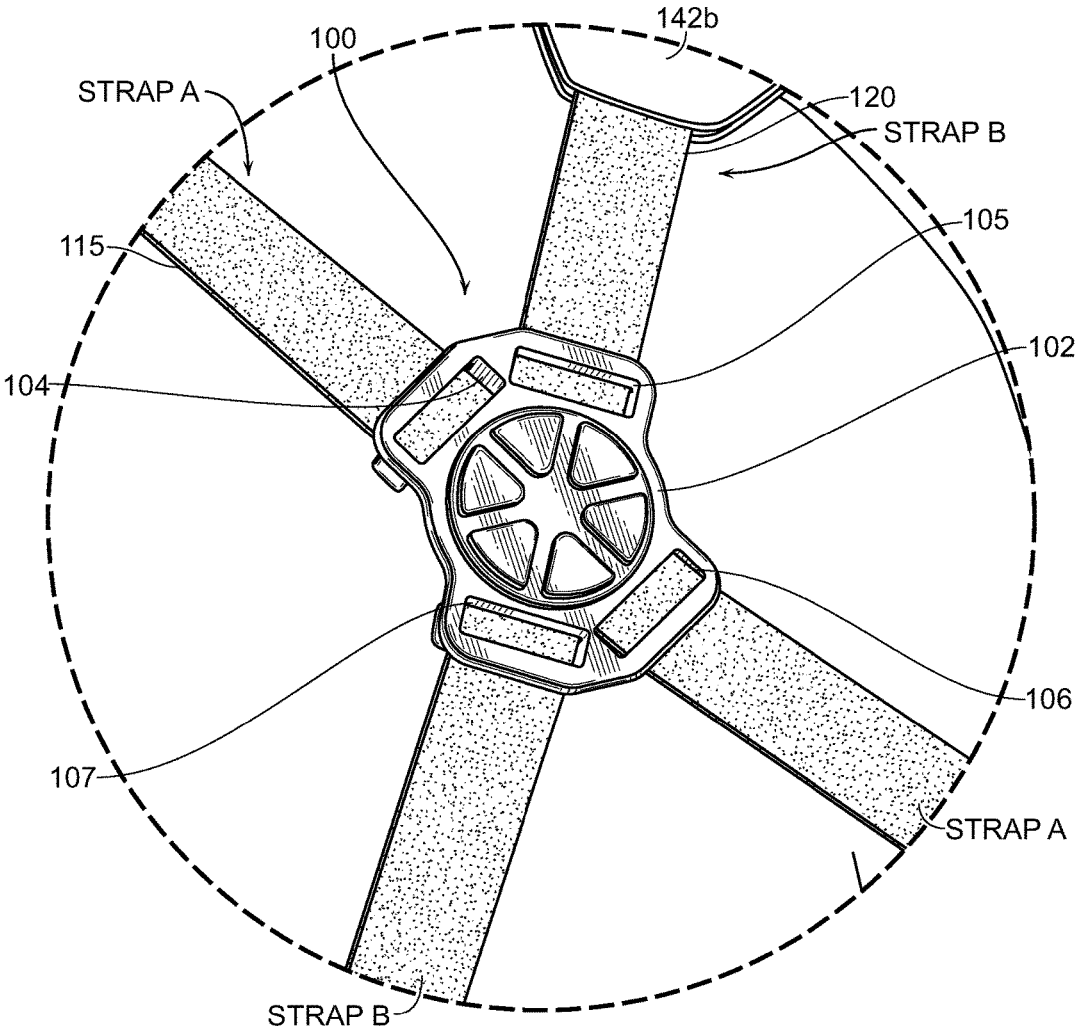
FIG. 6B is a close-up view of the hub shoulder strap connector shown in FIG. 6A.
Figure 10:
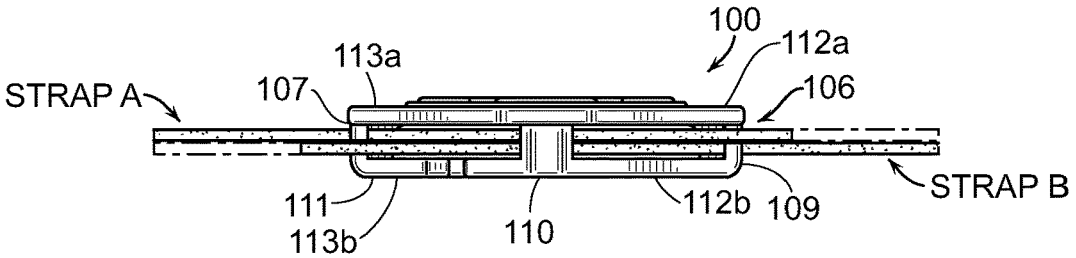
FIG. 10 is a front bottom side view of the hub strap connector shown in FIG. 9.
Figure 11:
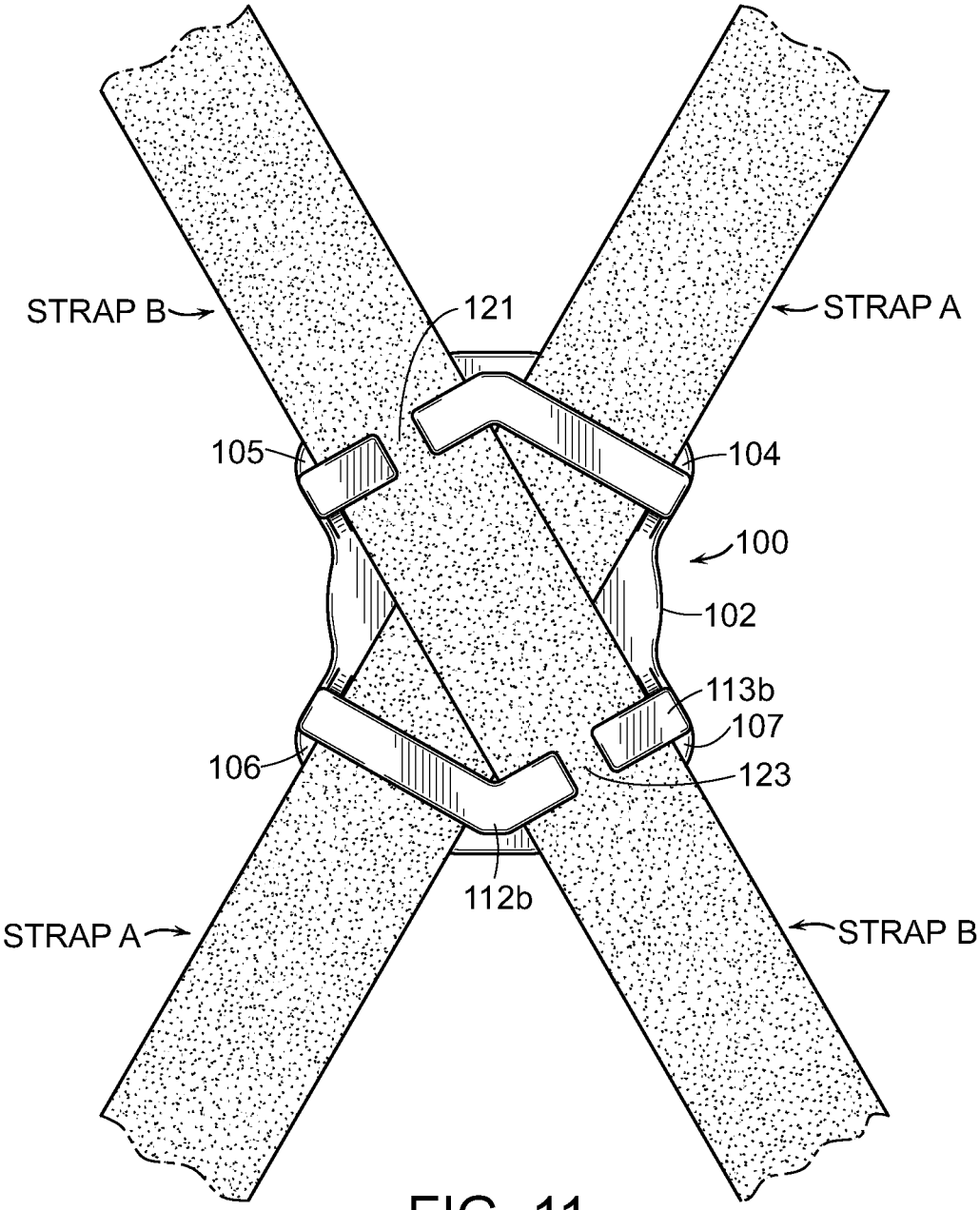
FIG. 11 is a rear view of one embodiment of the hub shoulder strap connector of this invention.

In another embodiment, a central hub connector having four (4) open slots for retaining the shoulder straps is provided. As shown in FIGS. 6A and 6B, the bag (98) includes a hub shoulder strap connector (100) for the shoulder strap assembly comprising strap (115) and strap (120). The hub strap connector (100) includes a plate (102) with four (4) raised open slot members (104, 105, 106, 107) positioned on the plate's perimeter. Strap (115) can be referred to as Shoulder Strap "A" and this strap extends through diagonally opposed slots (104, 106); while strap (120) can be referred to as Shoulder Strap "B" and this strap extends through diagonally opposed slots (105, 107). In this manner, the Shoulder Straps A and B are partially superimposed and criss-cross each other in the hub connector (100). Each slot (104, 105, 106, 107) includes vertical leg segments and upper and lower connecting horizontal crossbar segments that define openings for the Straps (A, B) to extend through. In FIG. 10, the slots (106, 107) are shown. Slot (106) includes vertical leg segments (109, 110) and upper and lower connecting horizontal crossbar segments (112*a*, 112*b*) that defines an opening for Strap A. Slot (107) includes vertical leg segments (110, 111) and a connecting horizontal crossbar segment (113) that defines an opening for Strap B. The openings in the slots are appropriately sized so that Straps A and B can fit and extend through. Referring to FIG. 11, which shows a rear view of the hub connector (100), the slots (105, 107) include cut-out openings (121, 123) in the lower crossbars of the slots. The Straps A and B can be pulled through these cut-out sections (121, 123) and removed from the hub connector (100) when needed as discussed further below. Preferably, at least two of the slots in the hub connector (100) include cut-out sections so that at least one strap can be removed cleanly and easily from the hub connector. In other embodiments, all four of the slots in the hub connector (100) include cut-out sections.

Referring back to FIGS. 6A and 6B, the slots (104, 105, 106, and 107) are located on the perimeter of the plate (102) of the hub strap connector (100). Two slots (104, 105) are located on the edges in the upper region, and two slots (106, 107) are located on the edges in the lower region. The plate (102) has a polygon-shaped with two arcuate sides that curve inwardly. However, it is understood the plate (102) can have any suitable shape. For example, the plate (102) can have a circular, oval, rectangular, hexagon, octagon, and other like shapes. The plate (102) can be of any color and made from various materials as discussed below. If desired, a logo, brand name, trademark, or any other text, picture, or symbol can be imprinted on the plate (102).

The plate (102) of the hub strap connector (100) can be made from any suitable material and preferably a relatively hard plastic. For example, polyester-polyether block copolymers such as Hytrel® resins, available from DuPont, can be used to make the hub connector. These block copolymers are available in different grades. Polyether-amide block copolymers, which are commonly known as Pebax® resins, and are available from Arkema, Inc. (Columbs, France), also may be used. Other suitable polymers include, but are not limited to, polyurethanes, polyureas, silicones, ethylene acid copolymer ionomers, polyesters, polyolefins, polyamides, polyamide-ethers, polyamide-esters; fluoropolymers, polystyrenes, polyvinyl chlorides, polycarbonates, polyethers, and polyimides including homopolymers, copolymers, and modified polymers and blends therof.

Figure 7:
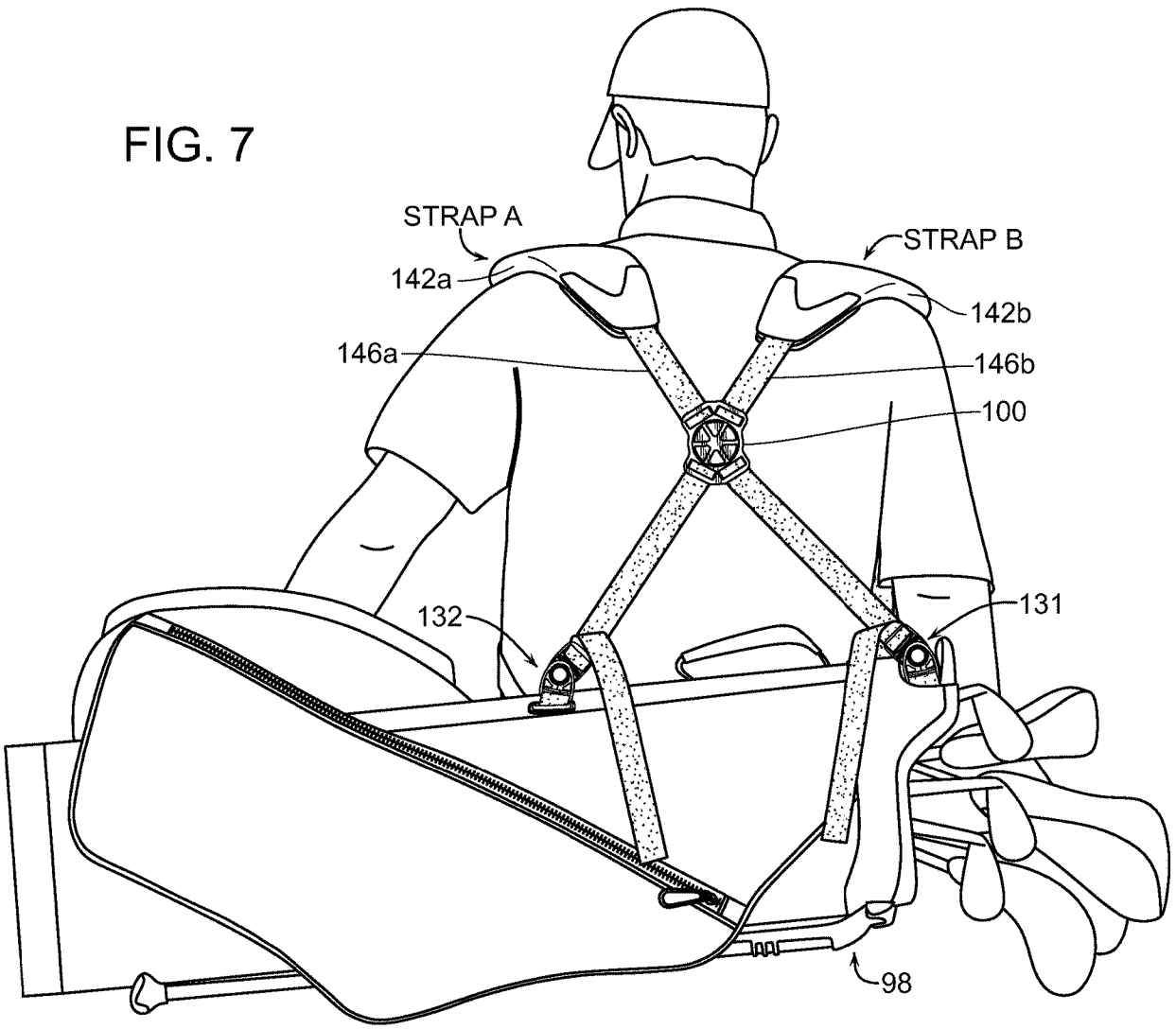
FIG. 7 is a second rear perspective view of a person carrying the golf bag of this invention with a hub shoulder strap connector, wherein the person is using two shoulder straps to carry the bag.
Figure 8:
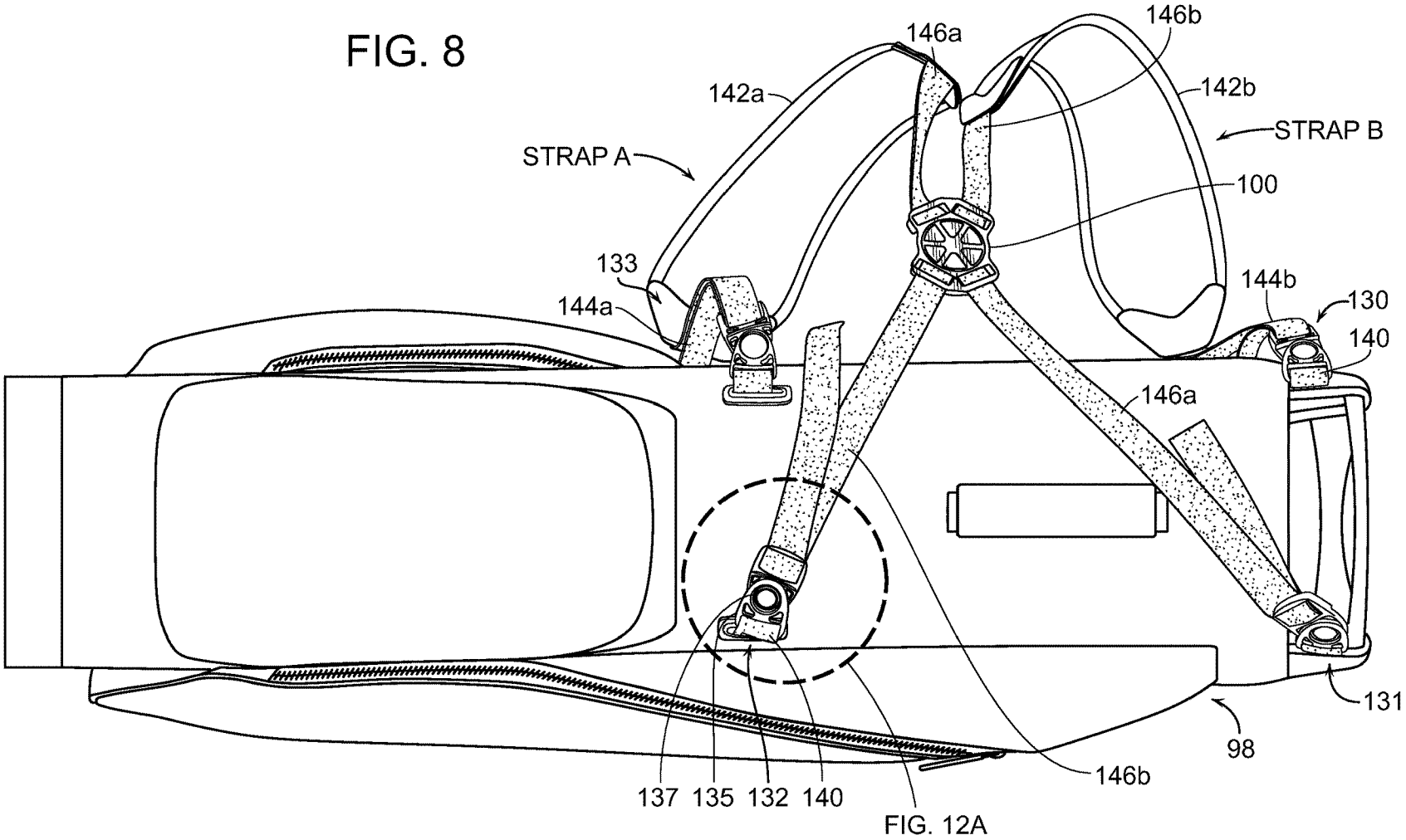
FIG. 8 is a perspective view of the golf bag of this invention with a hub shoulder strap connector showing shoulder Straps A and B removably coupled to the bag by four strap connector assemblies.
Figure 9:
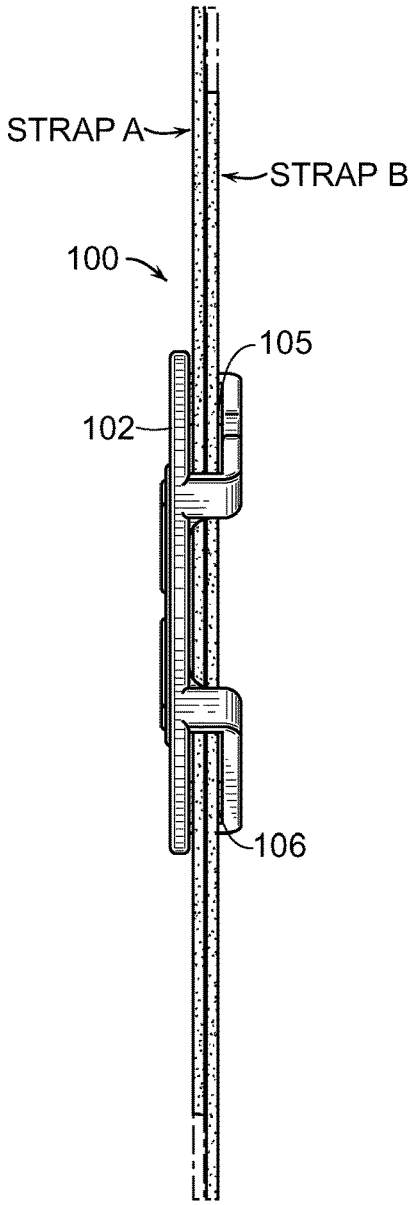
FIG. 9 is a front side view of one embodiment of the hub shoulder strap connector of this invention.
Figure 12A:
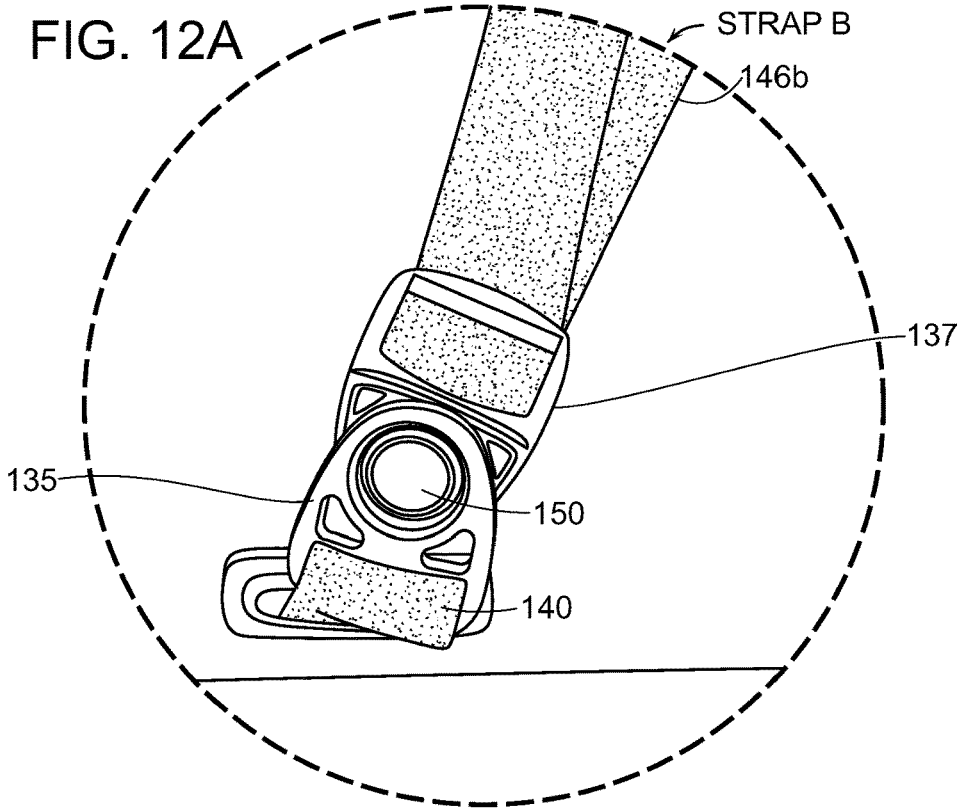
FIG. 12A is a close-up view of one strap connector assembly of this invention comprising a snap-in piece and receptor member for coupling the shoulder straps to the golf bag.
Figure 12B:
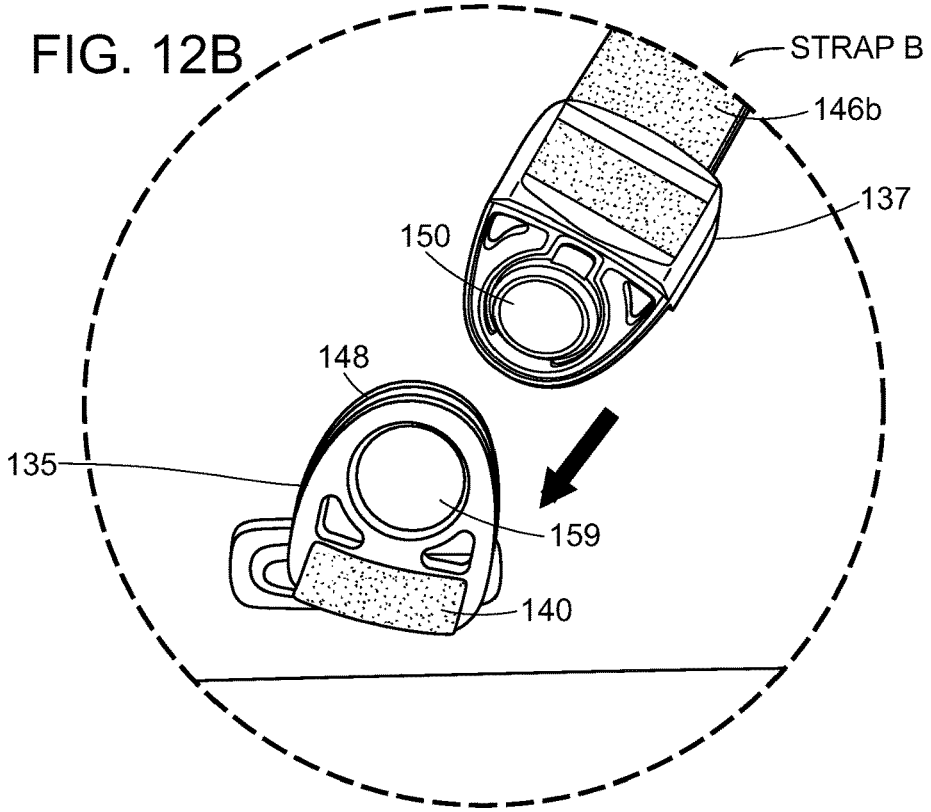
FIG. 12B is a close-up view of the strap connector assembly shown in FIG. 12A, wherein the snap-in piece is shown being inserted into the receptor member.

Turning to FIGS. 7 and 8, in one preferred embodiment, the Shoulder Straps A and B are removably coupled to the bag (98) by four (4) strap connector assemblies (130, 131, 132, and 133). In FIGS. 12A and 12B, these connector assemblies are shown in more detail and each assembly includes a pivotable receptor member (135) and snap-in piece (137). As shown in FIG. 8, two (2) receptor members are fixedly or removably attached to the upper portion of the bag (98), preferably the top-cuff (138). The other two (2) receptor elements are located in the lower portion of the bag (98). The receptor members may be attached to the bag (98) by webbing (140) or other suitable means.

Each shoulder strap (A and B) generally includes three segments. Primarily, Straps A and B include a cushioned portion (142*a*, 142*b*) made of a relatively thick, cushioned material. The cushioned portions (142*a*, 142*b*) rest on the golfer's shoulders so that the bag (98) is well supported and he/she can carry the bag comfortably. Each shoulder strap (A and B) also includes an upper connector webbing (144*a*, 144*b*) and a lower connector webbing (146*a*, 146*b*). As shown in FIG. 8, the upper connector webbing (144*a*, 144*b*) is used for attaching the straps to the connector assemblies (130, 133). Meanwhile, the lower connector webbing (146*a*, 146*b*) is used for attaching the straps to the connector assemblies (131, 132). The webbing is made of a relatively thin, short fabric material and has minimal or no padding.

In FIG. 8, Shoulder Strap A is shown having an upper connector webbing (144*a*) with two ends. One end (proximal) of the upper connector webbing (144*a*) is attached to the snap-in piece of the connector assembly (133), and this snap-in piece is coupled to the receptor element as described further below. This can be considered the first bag attachment point. This end of the connector webbing (144*a*) may be attached to the snap-in piece by first passing it through a buckle, tri-glide clip, slide piece, or other adjusting member that allows Shoulder Strap A to be adjusted. The opposing end (distal) of the upper connector webbing (144*a*) is attached to the cushioned portion (142*a*) of the shoulder strap. This end of the connector webbing (144*a*) may be attached to the cushioned portion (142*a*) by stitching, adhesive or other suitable means.

Concerning the lower connector webbing (146*a*) for Shoulder Strap A, this section also has two ends. One end (proximal) of the lower connector webbing (146*a*) is attached to the cushioned portion (142*a*) Shoulder Strap A by stitching or other means as described above. The lower connector webbing runs through the diagonally opposed slots (104, 106) of the hub connector (100) as described above. Meanwhile, the opposing end (distal) of the lower connector webbing (146*a*) is attached to the snap-in-piece of the connector assembly (131), and this snap-in piece is coupled to the receptor element as described further below. This can be considered the second bag attachment point. Thus, the upper end of Strap A extends from the first bag attachment point (as attached by upper connector webbing 144*a*), and the lower end of Strap A runs through the diagonally-opposed slots (104, 106) of the hub connector (100), to the second bag attachment point (as attached by lower connector webbing 146*a*).

Now, referring to Shoulder Strap B, this Strap B also has an upper connector webbing (144*b*) with two ends. One end (proximal) of the upper connector webbing (144*b*) is attached to the snap-in piece of the connector assembly (130), and this snap-in piece is coupled to the receptor element as described further below. This can be considered the third bag attachment point. Similar to above-described Shoulder Strap A, this end of the connector webbing (144*b*) may be attached to the snap-in piece by first passing it through a buckle, tri-glide clip, slide piece, or other adjusting member that allows the Shoulder Strap B to be adjusted. The opposing end (distal) of the upper connector webbing (144*b*) is attached to the cushioned portion (142*b*) of the Shoulder Strap B. This end of the upper connector webbing (144*b*) may be attached to the cushioned portion (142*b*) by stitching, adhesive or other suitable means.

Concerning the lower connector webbing (146*b*) for Shoulder Strap B, this section also has two ends. One end of the lower connector webbing (146*b*) for Shoulder Strap B is attached to the cushioned portion (142*b*) of Shoulder Strap B by stitching or other means as described above. The lower connector webbing (146*b*) runs through the diagonally opposed slots (105, 107) of the hub connector (100) as described above. The other end of the lower connector webbing (146*b*) is attached to the snap-in-piece of the connector assembly (132), and this snap-in piece is coupled to the receptor element. This can be considered the fourth bag attachment point.

As described above, the connector webbing for each bag attachment point (Points 1-4) is fastened to the snap-in-pieces of the connector assemblies (130, 131, 132, and 133), and these snap-in pieces are removably coupled to the receptor members. In FIGS. 12A and 12B, the strap connector assembly (132) is shown in more detail with the receptor member (135) contains a channel or slot (148) for receiving the snap-in piece (137). The snap-in piece (137) is inserted into the channel (148) of the receptor member (135) and snaps into place. Thus, the snap-in piece (137) is coupled to the receptor member (135) and Shoulder Straps A and B are removably attached to the golf bag (98).

In one preferred embodiment, the snap-in piece includes a relatively small, circular button (150). The button (150) is urged inwardly as the snap-in piece (137) slides into the channel (148) of the receptor member (135). The button (150) fits in a relatively small, circular aperture (159) within the channel (148). As the button (150) is captured within this channel (148), it snaps back outwardly to its original position. The button (150) is thus locked in place, and Shoulder Straps A and B are secured to the body of the bag (98).

It is recognized that the straps can be attached to the four attachment points of the bag by other mechanisms. For example, spring-loaded clips may be used to attach the straps to the body of the bag. Such spring-loaded clips are discussed above and shown in FIG. 1A. The spring-loaded clip (42) includes a spring-loaded sliding piece (44) and this may be used to secure the clip to a pivotal D-shaped or other suitably-shaped connector ring (40) located on the body of the bag. Other systems for attaching the webbing of the shoulder strap to the D-shaped connector ring include clasps, buckles, shackles, clips, snap buttons, laces, ties, hook and loop fasteners, and any other suitable fastening means Thus, as shown in FIG. 7, the shoulder straps A and B rest against the mid-back region of the golfer's back and criss-cross each other in the hub connector (100). The shoulder straps A and B form an X-shaped pattern, on the person's back region. The shoulder straps A and B can be finely adjusted to improve the weight distribution of the golf bag (98) on the shoulders. A golfer or caddy is better able to balance the golf bag when the golf bag is fitted properly on his/her shoulders. When there is proper spacing between the shoulder straps, there is better weight distribution and less weight stress is placed on each shoulder. The person carrying the golf bag tends to have improved balance while walking with the bag because of this improved weight distribution.

Figure 13A:
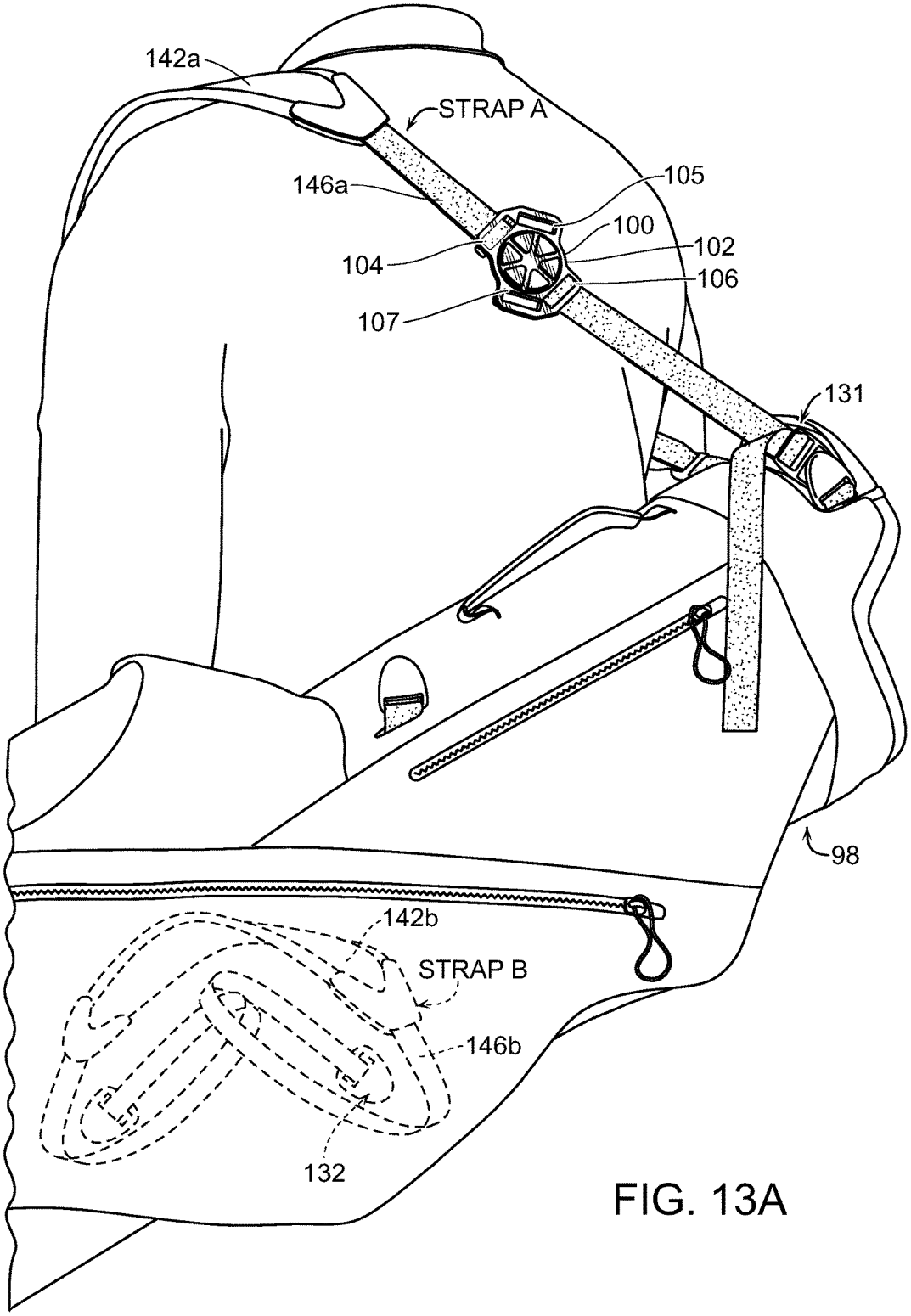
FIG. 13A is a rear perspective view of a person carrying the golf bag of this invention with a hub shoulder strap connector, wherein one shoulder strap has been removed and stored in a side pocket, and the person is using the other shoulder strap as a single strap to carry the bag.
Figure 13B:
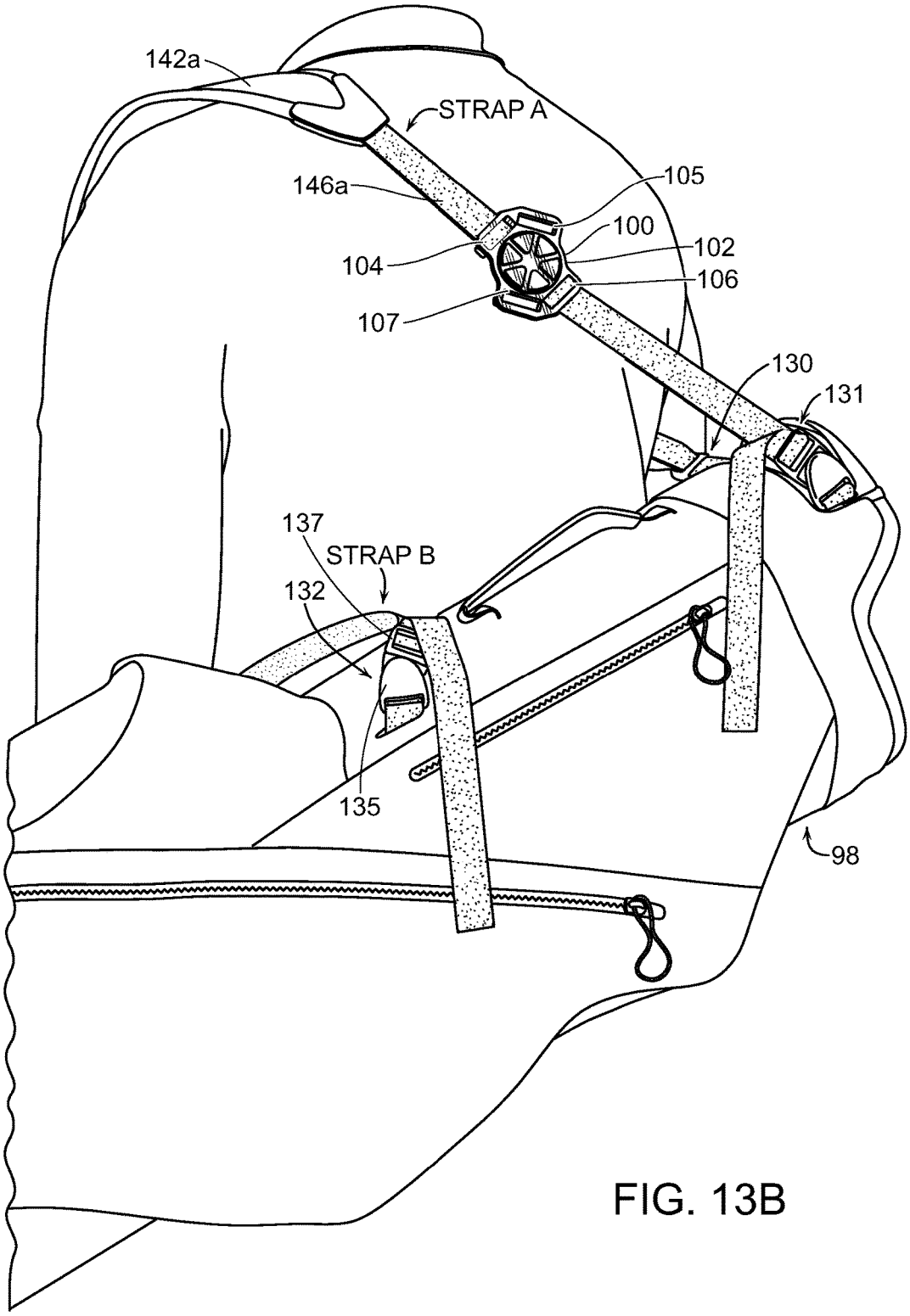
FIG. 13B is a rear perspective view of a person carrying the golf bag of this invention with a hub shoulder strap connector, wherein one shoulder strap has been removed from the shoulder but remains attached to the bag, and the person is using the other shoulder strap as a single strap to carry the bag.

As discussed above, the golf bag of this invention includes a two strap system that can be converted easily to a single strap system. In the two strap system, one strap is fitted over one shoulder and the second strap is fitted over the other shoulder so the weight of the bag is borne by both shoulders of a person carrying the bag as shown in FIG. 7. When needed, the two straps can be converted quickly to a single strap that is comfortably fitted over one shoulder so that the weight of the bag is borne by one shoulder. For example, referring to FIGS. 13A and 13B, to convert from a double-strap configuration (Shoulder Straps A and B) to a single strap configuration (Shoulder Strap A only), the user grasps one end of the Strap B between his/her thumb and index finger and pulls upwardly on this strap. This action causes Strap B to slide through the cut-out sections (121, 123) of the slots (105, 107) and away from the hub connector (100) (FIG. 11). In this way, Strap B is removed from the hub connector (100) and is loosened. At this point, Strap B is hanging loosely, but it is still attached to the bag (98) at the third and fourth bag attachment points by connector assemblies (130, 132). If desired, the user can completely remove Strap B from the bag by detaching it from the connector assemblies (130, 132). The user can then store Strap B in a pocket in the golf bag (98) as shown in FIG. 13A. In another version, if desired, the user can remove Strap B from the hub connector (100) but keep it attached to the bag (98). In this way, Strap B hangs loosely from the bag (98) but it remains fastened at the third and fourth bag attachment points by connector assemblies (130, 132) as shown in FIG. 13B.

As discussed above, in one example, Strap B, which is shown as being fitted on the right shoulder, is removed from the hub connector (100) as the double-strap assembly is converted to a single strap. In another example, Strap A, which is shown as being fitted on the left shoulder, is removed from the hub connector (100) to form a single strap assembly. The golfer then uses the Strap B to support the bag. Thus, either Strap A or Strap B can be used as a single strap. The golfer will select which single strap to use depending upon whether the golfer wants the bag to rest on his/her right or left shoulder.

In both the double-strap and single-strap instances, the straps are comfortably fitted over the shoulder(s) and the bag is easy to carry. The golf bag is lightweight and durable. As needed, the straps can be easily converted from a double to a single and back to a double-strap system. Thus, the amount of weight stress placed on each shoulder can be quickly adjusted. The person carrying the bag can decide which strap system he/she would like to use depending upon the playing circumstances. The golfer can easily change strap systems while walking the course. Because the strap system is so easily convertible, the golfer does not need to spend much time and energy fiddling with the straps, and he/she can better concentrate on their game.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

All patents, publications, test procedures, and other references cited herein, including priority documents, are fully incorporated by reference to the extent such disclosure is not inconsistent with this invention and for all jurisdictions in which such incorporation is permitted. It is understood that the compositions, golf ball components, and finished golf balls described and illustrated herein represent only some embodiments of the invention. It is appreciated by those skilled in the art that various changes and additions can be made to compositions and products without departing from the spirit and scope of this invention. It is intended that all such embodiments be covered by the appended claims.

We claim:

1. A golf bag having dual shoulder straps that can be converted to a single shoulder strap, the bag comprising:

an elongated tubular body for holding golf clubs; and a shoulder strap assembly, the assembly comprising:

i) a first shoulder strap (A) having an upper connector webbing, a cushioned portion, and a lower connector webbing, the upper connector webbing being removably attached to the bag at a first bag attachment point, and the lower connector webbing being removably attached to the bag at a second bag attachment point;

ii) a second shoulder strap (B) having an upper connector webbing, a cushioned portion, and a lower connector webbing, the upper connector webbing being removably attached to the bag at a third bag attachment point, and the lower connector webbing being removably attached to the bag at a fourth bag attachment point;

iii) a hub connector base plate, the hub plate having a first set of diagonally opposed elevated slots so the first strap (A) can extend through the slots and the hub plate having a second set of diagonally opposed elevated slots so the second strap (B) can extend through the slots, each slot in the second set of diagonally opposed slots comprising leg segments that extend upwardly from the base plate, the leg segments connected by an upper horizontally-extending crossbar that defines a channel for strap B to be inserted therethrough, the channels being on a different plane than the base plate, where the upper crossbar has a cut-out portion for removing strap B from the slot, and wherein the straps cross over each other in the hub connector and form an X-shaped pattern when the first strap (A) is fitted over one shoulder and the second strap (B) is fitted over an opposing shoulder of a person carrying the bag.

2. The golf bag of claim 1, wherein the cushioned portions of the first and second shoulder straps are each made of a foamed material.

3. The golf bag of claim 1, wherein the upper and lower connector webbing of the first and second shoulder straps is made of a nylon fabric material.

4. The golf bag of claim 1, wherein the upper and lower connector webbing of the first shoulder strap is attached to the bag at attachment points by connector assemblies.

5. The golf bag of claim 4, wherein each assembly includes a pivotable receptor member and a snap-in piece.

6. The golf bag of claim 1, wherein the upper and lower connector webbing of the second shoulder strap is attached to the bag at attachment points by connector assemblies.

7. The golf bag of claim 4, wherein each assembly includes a pivotable receptor member and a snap-in piece.

8. The golf bag of claim 1, wherein the upper and lower connector webbing of the first shoulder strap is attached to the body of the bag by spring-loaded dips.

9. The golf bag of claim 1, wherein the upper and lower connector webbing of the second shoulder strap is attached to the body of the bag by spring-loaded clips.

* * * * *